US006168850B1

(12) United States Patent
Kim et al.

(10) Patent No.: US 6,168,850 B1
(45) **Date of Patent: *Jan. 2, 2001**

(54) COMPOSITION FOR A PHOTO-CONDUCTIVE LAYER AND A METHOD FOR PREPARING A FLUORESCENT LAYER ON A CRT PANEL

(75) Inventors: Min-Ho Kim, Suwon-si; Jae-Ho Sim, Seoul, both of (KR)

(73) Assignee: Samsung Display Devices Co., Ltd., Suwon-si (KR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/094,137

(22) Filed: Jun. 9, 1998

(30) Foreign Application Priority Data

Jun. 10, 1997 (KR) ..... 97-23875

(51) Int. Cl.[7] ..... H01J 29/00

(52) U.S. Cl. ..... 428/195; 428/426; 428/690; 313/385; 430/900

(58) Field of Search ..... 430/58, 96, 56, 430/75, 83, 28, 58.15, 900; 428/195, 426, 432, 690; 427/64, 67, 68; 313/384, 385, 386, 466

(56) References Cited

U.S. PATENT DOCUMENTS

| | | | | |
|---|---|---|---|---|
| 4,751,163 | * | 6/1988 | Hagiwara et al. | 430/59 |
| 4,921,767 | * | 5/1990 | Datta et al. | 430/28 |
| 5,229,234 | * | 7/1993 | Riddle et al. | 430/28 |
| 5,413,885 | * | 5/1995 | Datta et al. | 430/28 |
| 5,827,628 | * | 10/1998 | Shin et al. | 430/28 |
| 5,834,144 | * | 11/1998 | Kim et al. | 430/28 |
| 5,840,817 | * | 11/1998 | Shim et al. | 526/284 |

FOREIGN PATENT DOCUMENTS 6-027694 * 2/1994 (JP) .

OTHER PUBLICATIONS

'Drift mobilities in amorphous charge–transfer complexes of trinitrofluorenone and poly–n–vinylcarbazole', W.D. Gill, J. Apply. Phys., vol. 43, No. 12, Dec. 1997, pp. 5033–5039.

* cited by examiner

*Primary Examiner*—Marie Yamnitzky
(74) *Attorney, Agent, or Firm*—Christie, Parker, & Hale LLP

(57) ABSTRACT

A composition for a photo-conductive layer and an electron transferring complex system on a color CRT panel having 1-(p-diethylaminophenyl)-1,4,4-triphenyl-1,3-butadiene as an electron donor and a thioxanthene derivative as an electron acceptor in an organic binder dispersion system have not only a high electron transferring capability but also a high electron generating capability so that it is not necessary to add a separate electron generating material.

5 Claims, 2 Drawing Sheets

COMPOSITION FOR A PHOTO-CONDUCTIVE LAYER AND A METHOD FOR PREPARING A FLUORESCENT LAYER ON A CRT PANEL

FIELD OF THE INVENTION

This invention relates to a composition for a photo-conductive layer, an electric charge transferring complex system and a method for preparing a fluorescent layer on a color cathode-ray tube(CRT).

BACKGROUND OF THE INVENTION

In general, a process for preparing a fluorescent layer on a color CRT panel includes the following steps. Photoresists such as polyvinyl alcohol and ammonium dichromate are laminated uniformly on the panel of a glass bulb of a cathode ray tube(CRT), and then dried by heating. The panel is assembled with a mask assembly, then the photoresists are partially exposed by light to form a dot or stripe pattern by ultra-violet (UV) ray irradiation through a shadow mask slot of the mask assembly. By doing that, the photoresist is fixed on the panel. The photoresists unexposed by the UV ray are removed by washing the panel with deionized distilled water. In the void space between the dot or the stripe pattern, a photo-absorbent such as graphite solution is laminated, dried by heating and then washed with hydrogen peroxide solution. Then the panel is washed by spraying distilled water under the high pressure to remove the UV ray exposed photoresists and the graphite on the photoresists. The panel is dried by being rotated at high speed, and the residual graphite forms a black matrix. After that, red, green and blue fluorescent materials are coated on the void space of the black matrix to form the fluorescent layer.

Methods for coating the red, green and blue fluorescent materials on the void space of the black matrix include the slurry method and the electrophotographic method. The slurry method includes the following steps. The red fluorescent material slurry is laminated uniformly on the panel. The panel is assembled with the mask assembly and exposed to light, and the mask is disassembled. Then the fluorescent material unexposed to light is removed by spraying deionized distilled water to form the red fluorescent dot or stripe pattern. The green and blue fluorescent materials are coated according to the same steps. But when exposing the green and blue fluorescent materials with light, the light is irradiated to the panel at different angles compared to the light for exposing the red fluorescent materials so that the three kinds of the fluorescent materials do not overlap. But this method has the problem that the fluorescent materials on the center and those on the edge of the panel are dried at different speeds, and therefore the widths of the dots on the center of the panel are much different from those on the edge, and the dots have bad shapes. Thus the color purity of the color CRT panel is deteriorated.

The electrophotographic method has been developed to solve the problem of the slurry method. The electrophotographic method includes the following steps. A photo-conductive layer is laminated on a conductive layer formed on the panel of the CRT. A surface electric potential is formed on the surface of the panel by electrification of the conductive layer. The panel is partially exposed by a visible ray to remove the electric charge on the exposed regions of the conductive layer. The fluorescent powder is sprayed on the regions in which the electric charge is removed so that dots or stripes of the fluorescent layer are formed. The photo-conductive layer plays the role of an insulating layer in darkness, but upon being irradiated by UV ray or visible ray, it produces electrons or holes.

FIG. 2 shows a structure of a photo-conductive layer for forming a fluorescent layer on a color CRT panel. As shown in FIG. 2, the photo-conductive layer 15 is formed on an organic conductive layer 13 formed on the panel of the color CRT 11, and includes an electric charge generating and transferring layer formed by dispersing the electric charge generating & transferring materials 21, 23.

A composition of the photo-conductive layer contains an organic binder, an electric charge generating and transferring material such as an electron donor and an electron acceptor, and a solvent. The electric charge generating & transferring materials are organic materials for transferring electrons or holes, and examples of the materials are hydrazone, styrene and triphenylamine compounds.

The electron donor and acceptor can transfer holes and electrons, respectively, but it is necessary to develop an electric charge transferring system transferring both holes and electrons in order to transfer the electric charge more efficiently and to simplify a process for preparing a fluorescent layer on a color CRT panel. For this end, the electric charge transferring system(PVK-TNF system) for transferring both holes and electrons was reported in J. Appl. Phys., 43(12), 5033(1972) by W. D. Gill. The system uses the electric charge transferring complex for transferring both positive charge and negative charge generated through photo-irradiation. But the PVK-TNF system has a low electric charge transferring capability of $10^{-7}$ $cm^2/Vs$, thus a separate electric charge generating material is needed for the system.

SUMMARY OF THE INVENTION

In order to solve the problems described above, an object of this invention is to provide a composition for a photo-conductive layer and an electric charge transferring complex system that have high electric charge transferring capability and that can be used without a separate electric charge generating material. The composition includes 1-(p-dialkylaminophenyl)-1,4,4-triphenyl-1,3-butadiene as an electron donor and a thioxanthene derivative as an electron acceptor in an organic binder dispersion system. The alkyl group of the electron donor is preferably an ethyl group. This invention also provides a method for preparing a fluorescent layer on a color CRT panel using them.

A first aspect of the present invention provides a composition for a photo-conductive layer on a color CRT panel containing 5~20% by weight of an organic binder, 0.5~20% by weight of 1-(p-dialkylaminophenyl)-1,4,4-triphenyl-1,3-butadiene having the formula 1, 0.1 to 20% by weight of a thioxanthene derivative having the formula 2 and 50 to 90% by weight of a solvent.

Formula 1

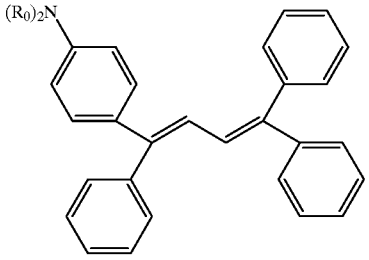

-continued

Formula 2

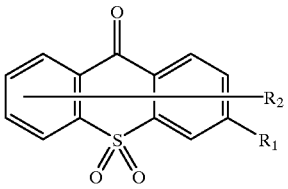

In formula 1, each $R_0$ independently represents an alkyl group. In formula 2, $R_1$ is selected from the group consisting of ethoxycarbonyl, butoxycarbonyl, phenoxycarbonyl, octylcarbonyl, benzyloxycarbonyl, ethyl, propyl, butyl, t-butyl, ethoxy, propoxy and butoxy groups, and $R_2$ is selected from the group consisting of hydrogen, halogen, alkyl, alkoxy, cyano, nitro, ester and trifiuoromethyl groups.

In the composition, the organic binder is preferably selected from the group consisting of polystyrene, polymethacrylate, α-methylstyrene, polycarbonate and styrene-acrylate copolymers, and the thioxanthene derivative is preferably n-butyl-9-oxo-9H-thioxanthene-3-carboxylate-10,10-dioxide.

A second aspect of the present invention provides an electric charge transferring complex system for a color CRT panel containing an organic binder of 5 to 20% by weight, 1-(p-dialkylaminophenyl)-1,4,4-triphenyl-1,3-butadiene having the above formula 1 of 0.5 to 20% by weight, a thioxanthene derivative having the above formula 2 of 0.1 to 20% by weight. In formula 1, the alkyl group is preferably an ethyl group.

In the electric charge transferring complex system, the organic binder preferably is selected from the group consisting of polystyrene, polymethacrylate, α-methylstyrene, polycarbonate and styrene-acrylate copolymers, and the thioxanthene derivative preferably is n-butyl-9-oxo-9H-thioxanthene-3-carboxylate-10,10-dioxide.

A third aspect of the present invention provides a method for preparing a fluorescent layer on a color CRT panel comprising the steps of forming a conductive layer on the panel of the CRT, forming a photo-conductive layer using the above-described composition on the conductive layer, forming black matrix pattern on the photo-conductive layer and coating red, green and blue fluorescent materials respectively between the black matrix pattern on the photo-conductive layer.

In the composition for the photo-conductive layer, the 1-(p-dialkylaminophenyl)-1,4,4-triphenyl-1,3-butadiene of formula 1 functions as an electron donor, that is, a material transferring positive charge, and the thioxanthene derivative of formula 2 functions as an electron acceptor, that is, a material transferring negative charge.

The n-butyl-9-oxo-9H-thioxanthene-3-carboxylate-10,10-dioxide compound can be obtained by an esterification reaction of 9-oxo-9H-thioxanthene-3-carboxylic acid-10,10-dioxide and 1-bromo butane.

The 1-(p-dialkylaminophenyl)-1,4,4-triphenyl-1,3-butadiene and the thioxanthene derivative are dispersed in a solvent to form an electric charge transferring complex system.

It can be determined by UV absorption spectra whether the electric charge transferring complex is formed or not. That is, the 1-(p-dialkylaminophenyl)-1,4,4-triphenyl-1,3-butadiene has maximal UV absorption peak in the wavelength of 395 nm and the thioxanthene derivative in the wavelength of 287 nm. The electric charge transferring complex formed by dispersing the two compounds has UV absorption peak of longer wavelength than those of the two respective compounds, and a solution containing the complex shows deep yellow color.

DETAILED DESCRIPTION OF THE PREFERRED EMBODIMENTS

Figure 1:
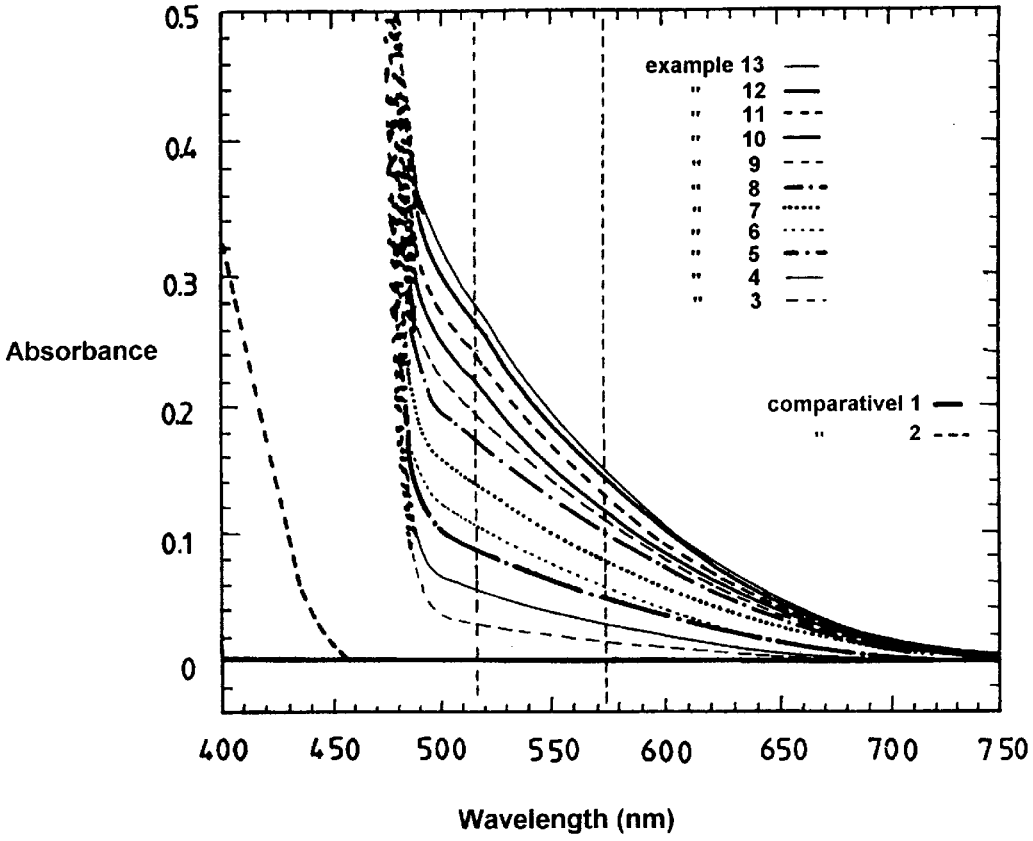
FIG. 1 shows UV absorption spectra of electric charge transferring complex systems according to the ratio of electron donor and acceptor.
Figure 2:
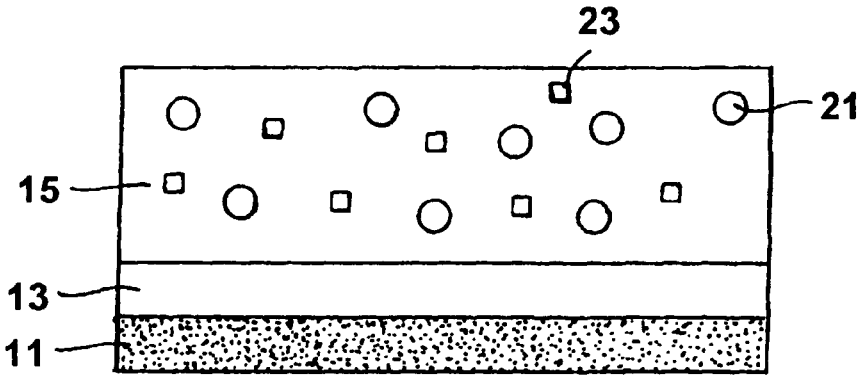
FIG. 2 shows a structure of a photo-conductive layer on a color CRT panel.

The present invention is further explained in more detail with reference to the following examples which do not limit this invention.

PREPARATION OF A THIOXANTHENE DERIVATIVE

EXAMPLE 1

20 g(69.4 mmol) of 9-oxo-9H-thioxanthene-3-carboxylic acid-10,10-dioxide and 23.8 g(173 mmol) of 1-bromo butane were dissolved in 250 ml of dimethylformamide. Sodium bicarbonate as a catalyst was added and the solution was maintained during 18 hours at 70° C. Then the solution was added to excess distilled water. The organic phase of the solution was separated and purified by silica gel column chromatography. The n-butyl-9-oxo-9H-thioxanthene-3-carboxylate-10,10-dioxide was obtained with the yield of 96.8%.

EXAMPLE 2

15 g (52 mmol) of 9-oxo-9H-thioxanthene-3-carboxylic acid-10,10-dioxide and 67.8 g(520 mmol) of 2-ethylhexanol were dissolved in 250 ml of dichloroethane. P-toluene sulfonyl monohydride was added as a catalyst and the solution was maintained during 20 hours at 110° C. Then the dichloroethane was removed by distillation under the atmospheric pressure and the 2-ethylhexanol was removed by distillation under the reduced pressure. Then the solution was purified by silica gel column chromatography. The 2-ethylhexyl-9-oxo-9H-thioxanthene-3-carboxylate-10,10-dioxide was obtained with the yield of 99%.

PREPARATION OF A COMPOSITION FOR A PHOTO-CONDUCTIVE LAYER ON A COLOR CRT PANEL

EXAMPLE 3

0.05 g of 1-(p-diethylaminophenyl)-1,4,4-triphenyl-1,3-butadiene and 0.1 g of n-butyl-9-oxo-9H-thioxanthene-3-carboxyalte-10,10-dioxide obtained from the above example 1 were dissolved in 2 ml of toluene.

EXAMPLES 4–13

The substantially same procedure as the above example 3 was carried out except that 0.02 g, 0.03 g, 0.04 g, 0.05 g, 0.06 g, 0.07 g, 0.08 g, 0.09 g, 0.10 g and 0.11 g of the n-butyl-9-oxo-9H-thioxanthene-3-carboxylate-10,10-dioxide were used, respectively.

COMPARATIVE EXAMPLE 1

0.05 g of 1-(p-diethylaminophenyl)-1,4,4-triphenyl-1,3-butadiene was dissolved in 2 ml of toluene.

COMPARATIVE EXAMPLE 2

0.05 g of the n-butyl-9-oxo-9H-thioxanthene-3-carboxylate-10,10-dioxide obtained from the above example 1 was dissolved in 2 ml of toluene.

COMPARATIVE EXAMPLE 3

The prior PVK-TNF system was used as a composition for a photo-conductive layer.

The UV absorption spectra were measured with UVNIS/NIR spectrometer (JASCO V-570) in order to determine whether or not an electric charge transferring complex systems were formed by examples 3 to 13 and comparative example 1 to 3. The measurements were carried out after 1 hour passed from the time of preparing the compositions.

The electric charge transferring capability and UV absorbency at 600 nm are shown in the table 1, and UV absorption spectra of the compositions of examples 3 to 13 and comparative examples 1 to 2 are shown in FIG. 1.

TABLE 1

| | degree of transferring electric charge ($cm^2/Vs$) | absorbency (600 nm) |
|---|---|---|
| example 3 | $10^{-6}$ | 0.0111 |
| example 4 | $10^{-6}$ | 0.0207 |
| example 5 | $10^{-6}$ | 0.0341 |
| example 6 | $10^{-6}$ | 0.0407 |
| example 7 | $10^{-6}$ | 0.0556 |
| example 8 | $10^{-6}$ | 0.0707 |
| example 9 | $10^{-6}$ | 0.0781 |
| example 10 | $10^{-6}$ | 0.0841 |
| example 11 | $10^{-6}$ | 0.0896 |
| example 12 | $10^{-6}$ | 0.0990 |
| example 13 | $10^{-6}$ | 0.1024 |
| comparative example 1 | $10^{-6}$ | 0 |
| comparative example 2 | $10^{-6}$ | 0 |
| comparative example 3 | $10^{-7}$ | 0 |

As shown in table 1 and FIG. 1, neither 1-(p-diethylaminophenyl)-1,4,4-triphenyl-1,3-butadiene nor n-butyl-9-oxo-9H-thioxanthene-3-carboxylate-10,10-dioxide alone shows an absorption peak at a wavelength longer than 500 nm, but the two compounds form a complex in toluene solvent, thus the complex shows absorption peaks at a wavelength longer than 500 nm. The complexes can be formed with various ratios of the electron acceptor to the electron donor, and the greater the amount of the electron acceptor, the higher the absorbency.

PREPARATION OF A FLUORESCENT LAYER ON A COLOR CRT PANEL

EXAMPLE 14

9.8% by weight of styrene-acrylate copolymer, 1.7% by weight of 1-(p-diethylaminophenyl)-1,4,4-triphenyl-1,3-butadiene and 0.33% by weight of n-butyl-9-oxo-9H-thioxanthene-3-carboxylate-10,10-dioxide were dissolved in 53 ml of toluene. A little surfactant was also dissolved sufficiently during 1 hour to form a photo conductive material. A photo-conductive layer having thickness of 3~6 $\mu$m was formed by a spin coating method on a CRT panel on which a conductive layer had been formed previously. 700 V of surface electric potential were supplied to the CRT panel by using Corona discharging method so that the positive charge could be formed on the conductive material. The surface electric potential was measured with a potential measuring instrument Model-344 manufactured by TREK, Co. In order to coat the fluorescent materials, the region of the CRT panel for green fluorescent materials was exposed to light using a mercury lamp as a light source. Then the green fluorescent materials which were electrified to have electric charge of 7 $\mu$C/g were coated on the region. The same processes were carried out on red and blue fluorescent materials so that the fluorescent layer on the color CRT panel was formed.

The composition for the photo-conductive layer and the electric charge transferring complex system has a capability not only of transferring an electric charge but also of generating the electric charge. Therefore it is not necessary to add a separate electric charge generating material and have higher electric charge transferring capacity, $10^{-6}$ $cm^2/Vs$, than that of the prior PVK-TNF system, $10^{-7}$ $cm^2/Vs$.

What is claimed is:

1. A cathode ray tube comprising:

a glass bulb having at least one panel;

a conductive layer coated on the panel;

a photoconductive layer coated on the conductive layer, the photoconductive layer including an electric charge transferring complex system comprising:

an organic binder;

1-(p-dialkylaminophenyl)-1,4,4-triphenyl-1,3-butadiene of formula 1; and a thioxanthene derivative of formula 2;

Formula 1

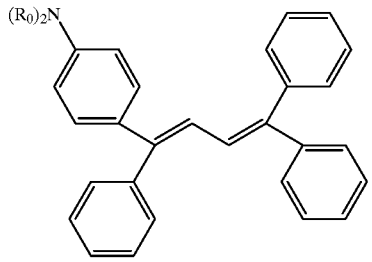

Formula 2

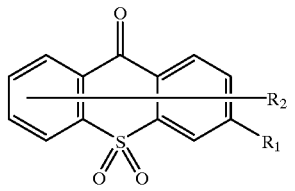

wherein in formula 1 each ($R_0$) independently represents an alkyl group, and in formula 2, $R_1$ is selected from the group consisting of ethoxycarbonyl, butoxycarbonyl, phenoxycarbonyl, octylcarbonyl, benzyloxycarbonyl, ethyl, propyl, butyl, t-butyl, ethoxy, propoxy and butoxy groups, and $R_2$ is selected from the group consisting of hydrogen, halogen, alkyl, alkoxy, cyano, nitro, ester and trifluoromethyl groups;

a black matrix formed in a pattern having voids on the photoconductive layer; and phosphors coated in the voids of the black matrix pattern.

2. The cathode ray tube of claim 1, wherein said organic binder is selected from the group consisting of polystyrene, polymethacrylate, α-methylstyrene, polycarbonate and styrene-acrylate copolymers.

3. The cathode ray tube of claim 1, wherein said thioxanthene derivative is n-butyl-9-oxo-9H-thioxanthene-3-carboxylate-10,10-dioxide.

4. The cathode ray tube of claim 1, wherein each $R_0$ independently represents an ethyl group.

5. A cathode ray tube according to claim 1, wherein the weight ratio of the compound of formula 1 to the compound of formula 2 ranges from about 5:1 to about 1:2.2.

* * * * *